United States Patent [19]

Rodondi

[11] 3,977,756

[45] Aug. 31, 1976

[54] TRANSITIONAL CONNECTOR FOR PRINTED CIRCUITS

[75] Inventor: Andrew F. Rodondi, Sharpsville, Pa.

[73] Assignee: General Motors Corporation, Detroit, Mich.

[22] Filed: Sept. 22, 1975

[21] Appl. No.: 615,232

[52] U.S. Cl. ..... 339/176 MF; 339/17 F; 339/91 R; 339/176 MP

[51] Int. Cl.[2] ..... H01R 13/54

[58] Field of Search ..... 339/17 F, 91 R, 176 MF, 339/176 MP

[56] References Cited

UNITED STATES PATENTS

| | | | |
|---|---|---|---|
| 2,858,515 | 10/1958 | Turnander | 339/176 MP |
| 3,154,365 | 10/1964 | Crimmins | 339/176 MP |
| 3,319,216 | 5/1967 | McCullough | 339/176 MP |
| 3,629,787 | 12/1971 | Wilsen | 339/17 F |

*Primary Examiner*—Roy Lake
*Assistant Examiner*—Mark S. Bicks
*Attorney, Agent, or Firm*—F. J. Fodale

[57] ABSTRACT

A flexible printed circuit is connected to a hardboard printed circuit by a cap which receives an end portion of the hardboard printed circuit having continuous portions at one end of the flexible printed circuit wrapped longitudinally thereabout. The hardboard printed circuit has a longitudinal latch portion which extends through aligned slots in the flexible printed circuit and cap and engages an extending finger of the cap. A portion of the flexible printed circuit disposed in the cap carries a resilient pad for biasing the conductor strips of the printed circuits into engagement.

2 Claims, 4 Drawing Figures

TRANSITIONAL CONNECTOR FOR PRINTED CIRCUITS

This invention relates to connectors for printed circuits and more particularly to transitional connectors for connecting flexible and hardboard printed circuits.

Such connectors are generally known from the U.S. Pat. No. 3,629,787 issued to James Wilson on Dec. 21, 1971 for a "Connector for Flexible Circuitry".

The object of this invention is to provide a connector which is less complicated, provides more positive retention, is more easily assembled, and generally improves upon the connectors disclosed in the aforementioned patent.

The exact nature of this invention as well as other objects and advantages thereof will be readily apparent from consideration of the following specification relating to the annexed drawing in which.

Figure 1:
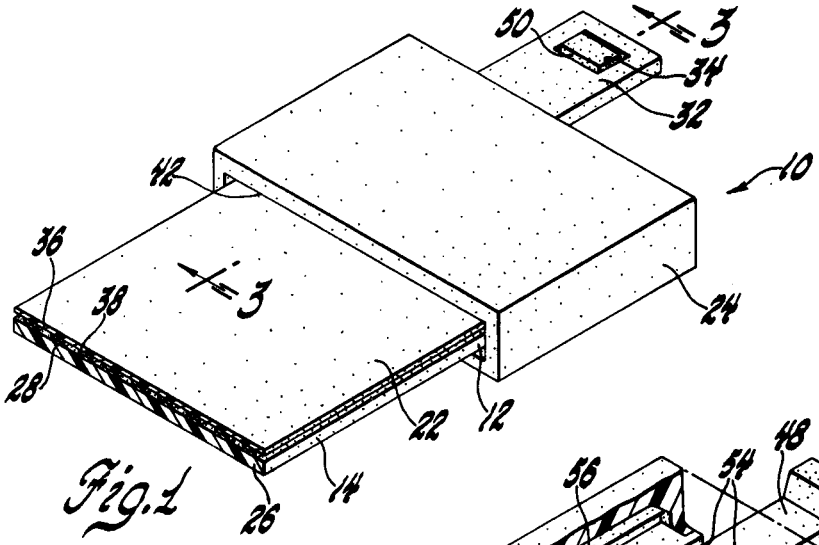
FIG. 1 is a perspective view of a connector in accordance with this invention.
Figure 2:
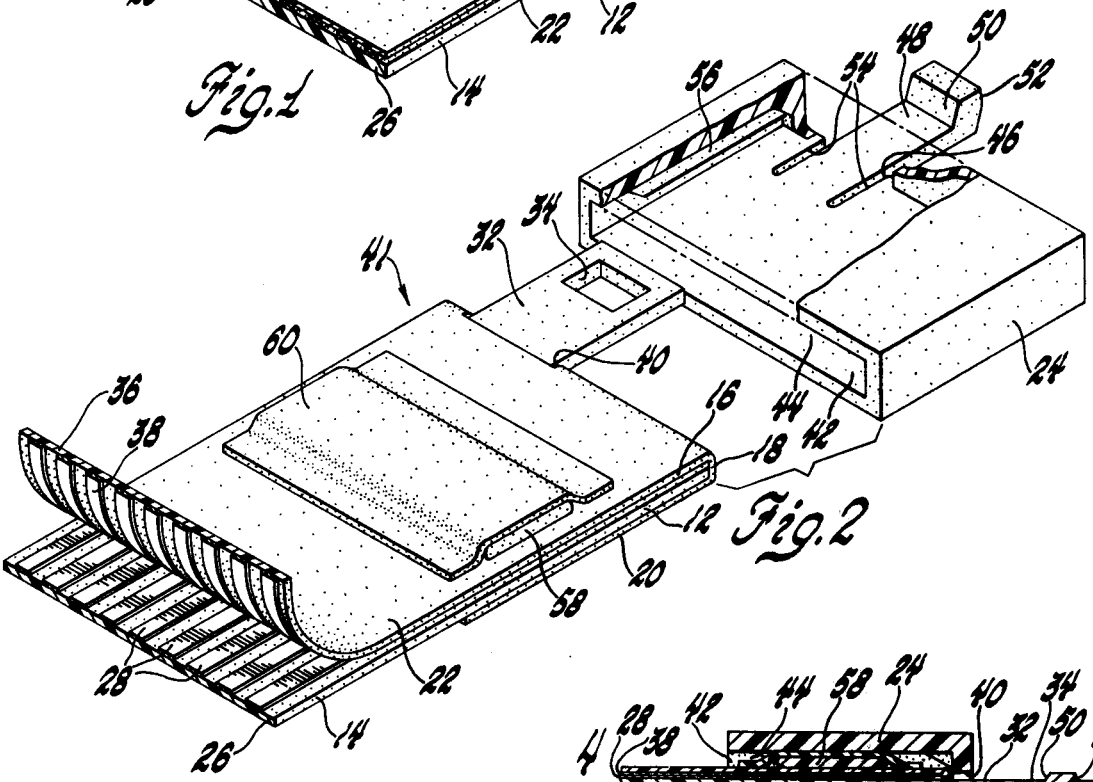
FIG. 2 is an exploded perspective view showing the connector of FIG. 1 partially assembled.

Referring now to FIG. 1 and 2 of the drawings, the connector 10 comprises an end portion 12 of a hardboard printed circuit 14, continuous portions 16, 18 and 20 at one end of a flexible printed circuit 22, and a unitary cap 24 of moldable rigid dielectric material such as nylon.

The hardboard printed circuit 14 comprises a rigid nonconductive planar substrate 26 upon which a plurality of longitudinal conductor strips 28 of copper or other suitable electrically conductive material are mounted in transversely spaced relationship. The strips 28 terminate adjacent the transverse edge 30 of the substrate 26 which includes a longitudinal latch portion 32 of reduced transverse dimension projecting forwardly of the transverse edge 30. The latch portion 32 has a square shaped hole 34 for cooperative latching engagement with the cap 24 and is closer to one longitudinal edge of the substrate 26 for properly locating the flexible printed circuit 22 as will hereinafter more fully appear.

Figure 3:
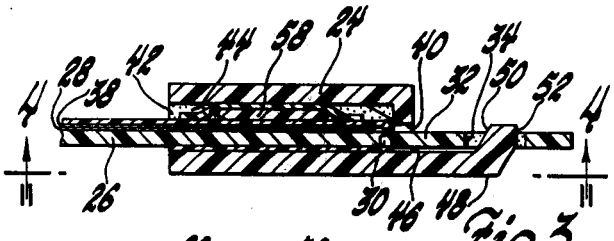
FIG. 3 is a section taken substantially along the line 3—3 of FIG. 1 in the direction of the arrows.
Figure 4:
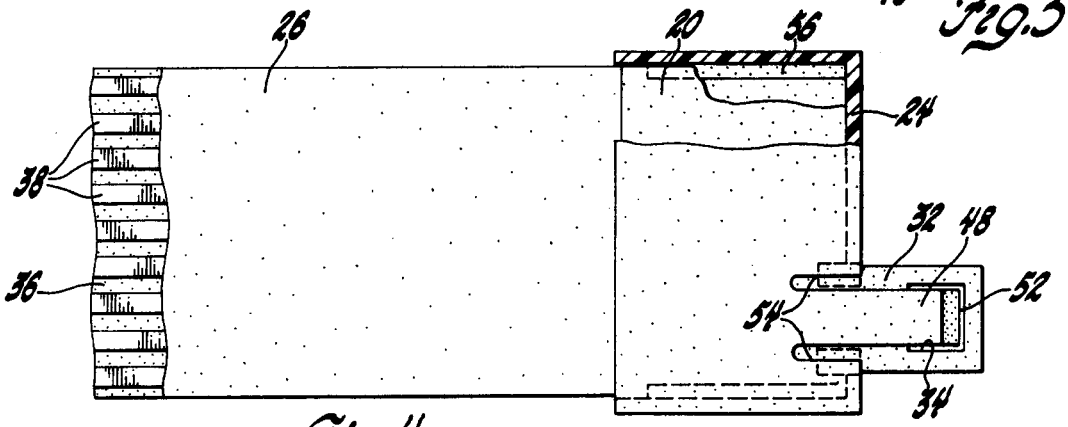
FIG. 4 is a view substantially along the line 4—4 of FIG. 3 in the direction of the arrows and with parts of the connector broken away.

The flexible printed circuit 22 comprises a thin sheet 36 of relatively flexible dielectric material such as Mylar upon which a plurality of longitudinal strips of copper or other suitable electrically conductive material are mounted in transversely spaced relationship. As shown in FIG. 2, the pattern of the strips 38 is the mirror image of the pattern of the strips 28 and thus the strips 38 and 28 are electrically connected when the flexible printed circuit 22 is properly placed against the hardboard printed circuit 14. The conductor strips 38 terminate short of the juncture between the first end portion 16 and the intermediate portion 18 of the flexible printed circuit 22 as shown in FIG. 3. This facilitates the longitudinal wrap of the portions 16, 18 and 20 about the end portion 12 of the substrate 14 and the inclusion of a rectangular hole 40 in the intermediate portion 18 which mates with the latch portion 32 of the substrate 14 to properly locate the flexible printed circuit 22 and provide a strain relief for the flexible printed circuit 22 at least during assembly. The flexible printed circuit 22 is preferably prebent at the junctures between the intermediate portion 18 and the end portions 16 and 20 to facilitate its attachment to the hardboard printed circuit 14 to form the subassembly 41.

The cap 24 has a rearward transverse slot 42 opening into a longitudinal cavity 44 and a rearward slot 46 of reduced transverse dimension extending part way up from the floor of the cavity 44. The cap 24 also has a longitudinal finger 48 extending forwardly from the bottom wall of the cap 24 in alignment with the slot 46. The end of the finger 48 extends upwardly providing a ramp 50 and a latch shoulder 52. The effective length of the finger 48 and thus its resilient deflection in the transverse direction may be increased by slots 54 separating it from adjacent portions of the bottom wall. The cap 24 also includes internal side rails 56 which depend from the roof of the cavity 44 and engage the first end portion 16 of the flexible printed circuit 22 when the subassembly 41 and cap 24 are assembled. When so assembled, the conductor strips 28 and 38 are biased into engagement by a resilient pad 58 of polyether foam or other suitable material. The resilient pad 56 may be carried on the first end portion 16 of the flexible printed circuit 22 by a patch 60 of matching or compatible material laminated at its longitudinal ends to the surface of the sheet 36 remote from the conductor strips 38. The pad 58 and the patch 60 are of reduced transverse dimension to avoid interference with the side rails 56 of the cap.

Focussing on FIG. 2, the subassembly 41 and cap 24 are assembled simply by inserting the subassembly 41, latching portion 32 first, into the cavity 44 via the slot 42 until the latching portion 32 passes through the slot 46 and is latched in position by the finger 48.

I wish it to be understood that I do not desire to be limited to the exact details of construction shown and described, for obvious modifications will occur to a person skilled in the art.

What is claimed is:

1. A transitional connector for connecting flexible and hardboard printed circuit comprising, a unitary cap of moldable rigid dielectric material having a rearward transverse slot opening into a cavity and a forward slot of reduced transverse dimension exiting from said cavity, said cap having a longitudinal, forwardly projecting finger which has a latch shoulder spaced forwardly of and aligned with said forward slot, said finger being resiliently deflectable in a transverse direction, a hardboard printed circuit comprising a rigid nonconductive substrate having an end portion with conductor portions on a surface thereof which terminate adjacent a transverse edge thereof, said rigid substrate having a longitudinal latch portion of reduced transverse dimension projecting forwardly of said transverse edge, A flexible printed circuit having a first end portion, an intermediate portion and a second end portion which are continuous at one end thereof and wrapped longitudinally about the end portion of said rigid substrate, said first end portion having conductor portions on a surface thereof engaging respective conductor portions on said surface of said rigid substrate of said hardboard printed circuit, said intermediate portion having a transverse slot through which the latch portion of the rigid substrate projects and said second end portion engaging an opposite surface of said substrate, said end portion of said hardboard printed circuit having said flexible printed circuit portions wrapped longitudinally thereabout being disposed in the cavity of said cap via said rearward transverse slot, said latch portion of said rigid substrate projecting through said forward slot and engaging said latch shoulder of said resiliently deflectable finger to prevent withdrawal of said rigid substrate, and elastomeric means disposed in said cap and engaging said flexible printed circuit for biasing said conductor strip portions into intimate contact.

2. A transitional connector for connecting flexible and hardboard printed circuits comprising, a unitary cap of moldable rigid dielectric material having a rearward transverse slot opening into a cavity and a forward slot of reduced transverse dimension extending part way up from a bottom wall and exiting from said cavity, said cap having internal side rails depending from a top wall and a longitudinal finger projecting forwardly of said bottom wall in alignment with said forward slot, said finger being resiliently deflectable in a transverse direction and having an upwardly extending latch shoulder spaced forwardly of the forward slot, a hardboard printed circuit comprising a rigid nonconductive substrate having an end portion with conductor portions on a surface thereof which terminate adjacent a transverse edge thereof, said rigid substrate having a longitudinal latch portion of reduced transverse dimension projecting forwardly of said transverse edge, said latch portion being offset in the transverse direction, a flexible printed circuit having a first end portion, an intermediate portion and a second end portion which are continuous at one end thereof and wrapped longitudinally about the end portion of said rigid substrate, said first end portion having conductor portions on a surface thereof engaging respective conductor portions on said surface of said rigid substrate of said hardboard printed circuit, said intermediate portion having a mating transverse slot through which the latch portion of the rigid substrate projects and said second end portion engaging an opposite surface of said substrate, said end portion of said hardboard printed circuit having said flexible printed circuit portions wrapped longitudinally therearound being disposed in the cavity of said cap via said rearward transverse slot, said latch portion of said rigid substrate projecting through said forward slot and engaging said latch shoulder of said resiliently deflectable finger to prevent withdrawal of said rigid substrate, and an elastomeric pad disposed in the cavity of said cap between said side rails and carried on a surface of said flexible printed circuit remote from said conductor strip portions by a laminated patch, said elastomeric pad biasing said conductor strip portions into intimate contact.

* * * * *